US006367483B1

(12) United States Patent
Chen et al.

(10) Patent No.: US 6,367,483 B1
(45) Date of Patent: Apr. 9, 2002

(54) HAIRDYE COMB

(76) Inventors: Huang-Wen Chen; Suz-Chou Yang, both of 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/849,465

(22) Filed: May 3, 2001

(51) Int. Cl.[7] ..... A45D 24/22
(52) U.S. Cl. ..... 132/112; 132/115
(58) Field of Search ..... 132/112, 113, 132/114, 115, 116, 120, 121, 126, 129, 136, 141; 401/195, 126, 129, 124, 123, 270, 118, 137, 138, 268

(56) References Cited

U.S. PATENT DOCUMENTS 3,386,185 A * 6/1968 Angelillo ..... 132/112
3,868,495 A * 2/1975 Dyer ..... 219/368
4,938,621 A * 7/1990 Pyrozyk ..... 401/289
5,725,130 A * 3/1998 Kluge et al. ..... 222/192
6,257,246 B1 * 7/2001 Kan ..... 132/112

* cited by examiner

*Primary Examiner*—John J. Wilson
*Assistant Examiner*—Robyn Kieu Doan

(57) ABSTRACT

A hairdye comb has a bottle-shaped handle having a neck, a connection disk, a comb strip, a tube passing through the connection disk, a hollow seat connected to the comb strip, a plurality of teeth disposed on the comb strip, and a plurality of slots formed on the comb strip. The connection disk has a valve diaphragm and a through hole. The pipe has an inner flange. The ball is inserted in the pipe. The hose is connected to the pipe and the tube. The connection disk is inserted in the neck of the bottle-shaped handle. The neck of the bottle-shaped handle is inserted in the hollow seat.

1 Claim, 5 Drawing Sheets

HAIRDYE COMB

BACKGROUND OF THE INVENTION

The present invention relates to a hairdye comb. More particularly, the present invention relates to a hairdye comb which can dye a hair of a user directly.

A conventional hairdye comb is dipped into a hairdye solution in order to dye a hair of a user. The conventional hairdye comb should be dipped into the hairdye solution many times before the hairdye treatment is finished.

SUMMARY OF THE INVENTION

An object of the present invention is to provide a hairdye comb which can dye a hair of a user directly.

Another object of the present invention is to provide a hairdye comb which can be detached in order to clean a bottle and a comb strip separatively.

Accordingly, a hairdye comb comprises a bottle-shaped handle, a ball, a hose, a connection disk, a comb strip, and a pipe disposed in the bottle-shaped handle. The bottle-shaped handle has a neck having an outer thread. A tube passes through the connection disk. A hollow seat is connected to the comb strip. A plurality of teeth are disposed on the comb strip. A plurality of slots are formed on the comb strip. The hollow seat has an inner thread and a round aperture. The connection disk has a valve diaphragm and a through hole communicating with the valve diaphragm. The pipe has an inner flange. The ball is inserted in the pipe and blocked by the inner flange of the pipe. The hose is connected to the pipe and the tube. The connection disk is inserted in the neck of the bottle-shaped handle. The neck of the bottle-shaped handle is inserted in the hollow seat. The inner thread of the hollow seat engages with the outer thread of the neck of the bottle-shaped handle. The tube communicates with the round aperture of the hollow seat.

DETAILED DESCRIPTION OF THE INVENTION

Figure 1:
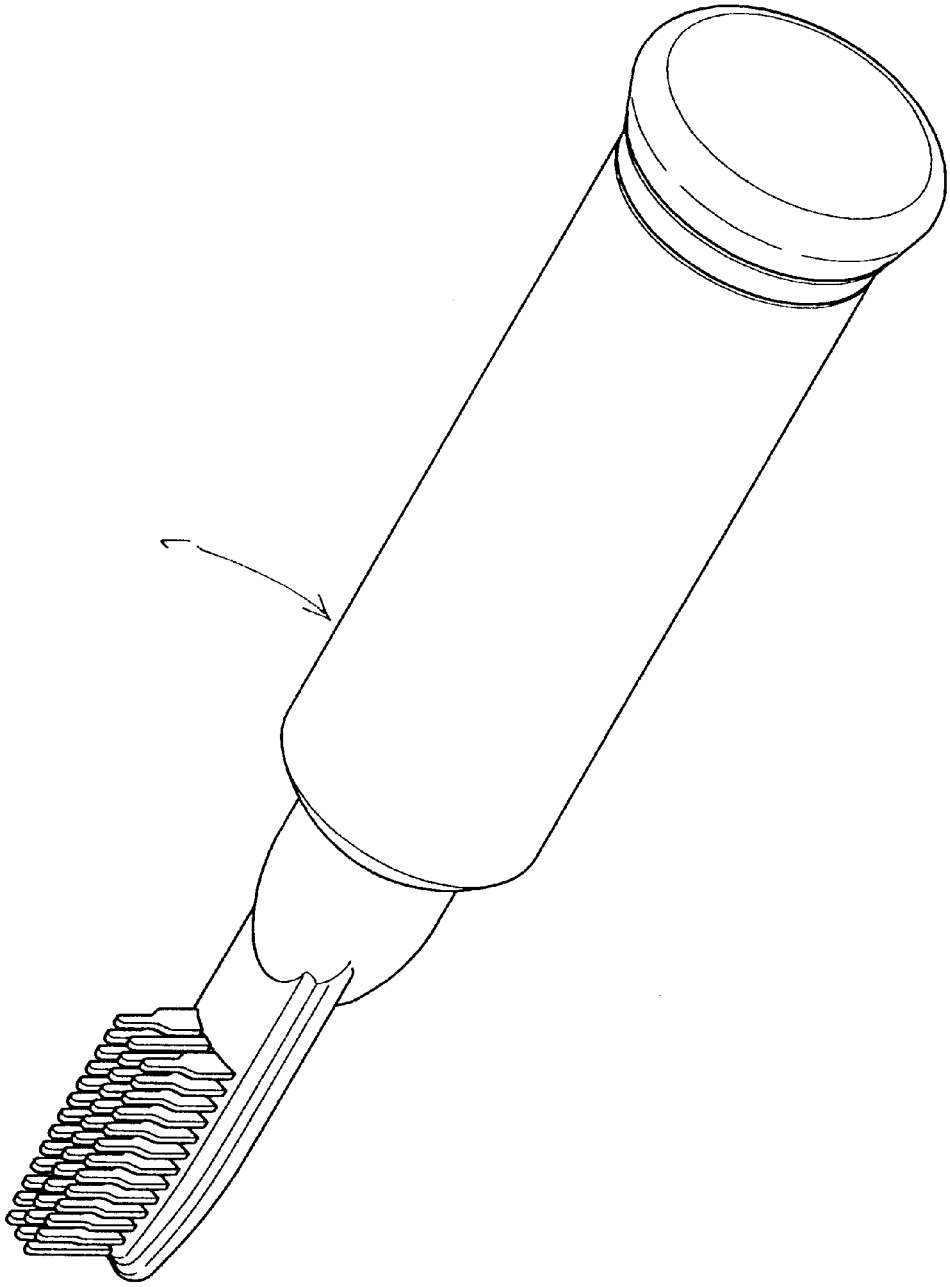
FIG. 1 is a perspective assembly view of a hairdye comb of a preferred embodiment in accordance with the present invention.
Figure 2:
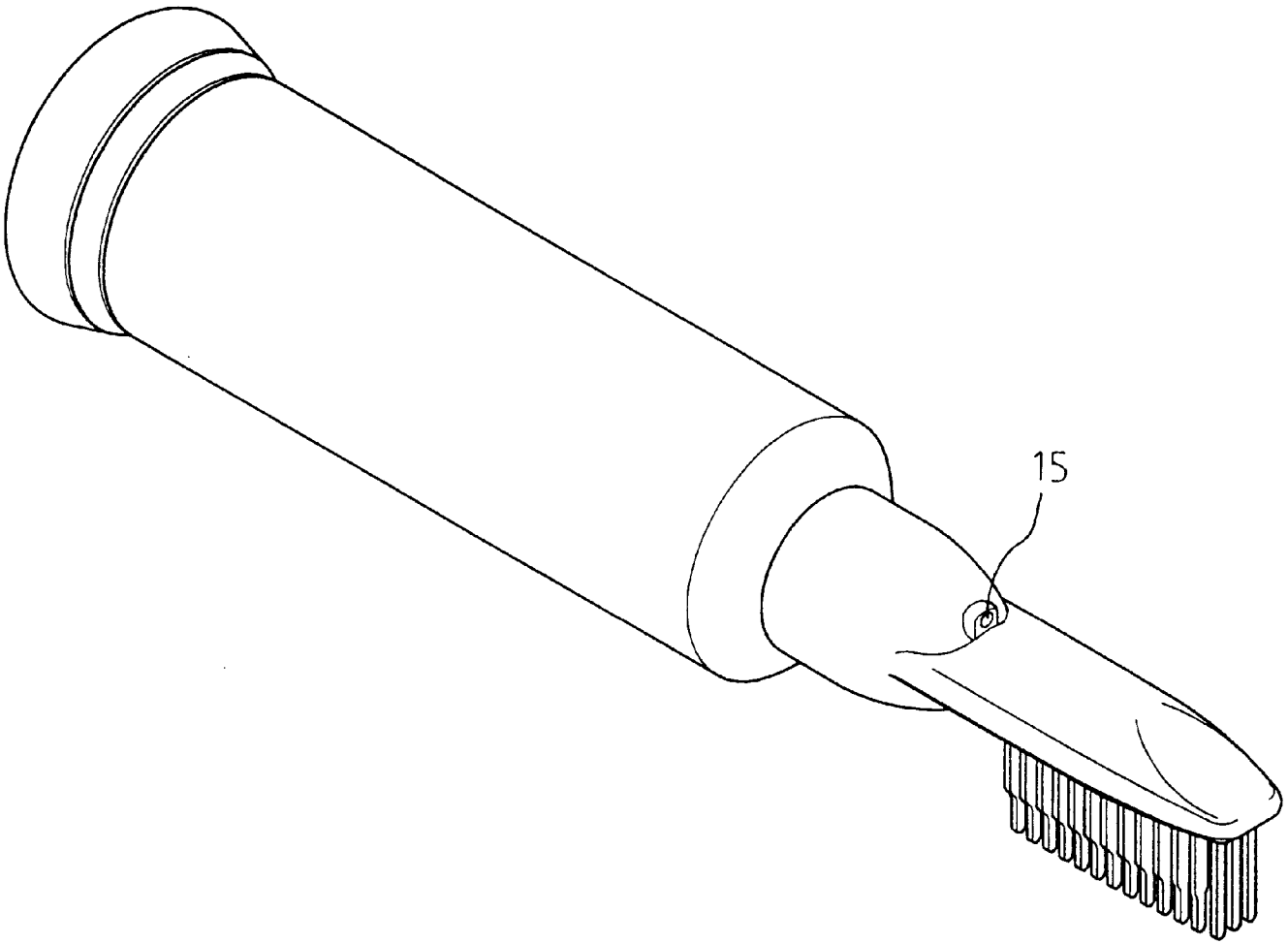
FIG. 2 is another perspective assembly view of a hairdye comb of a preferred embodiment in accordance with the present invention.
Figure 3:
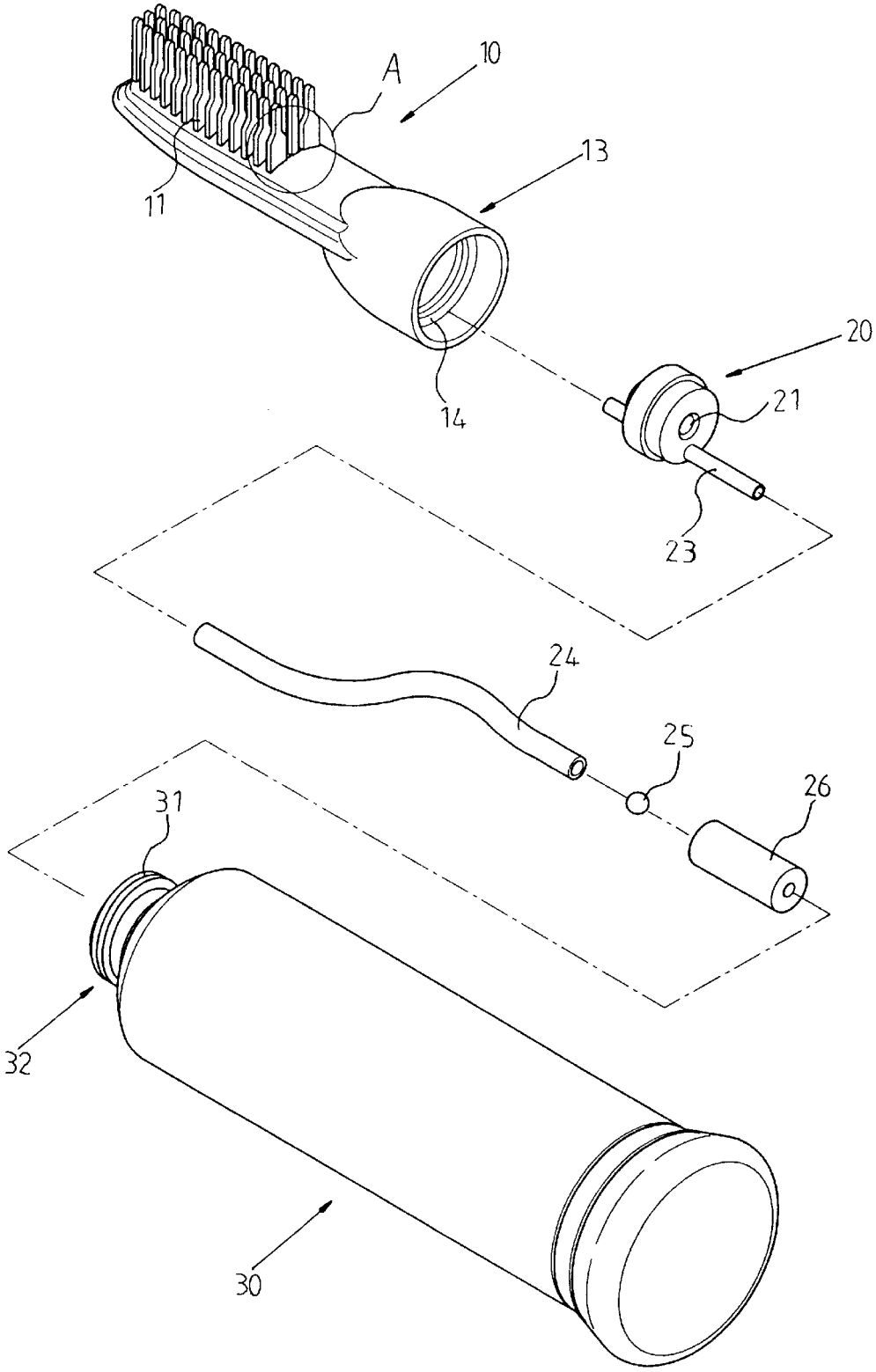
FIG. 3 is a perspective exploded view of a hairdye comb of a preferred embodiment in accordance with the present invention.
Figure 3A:
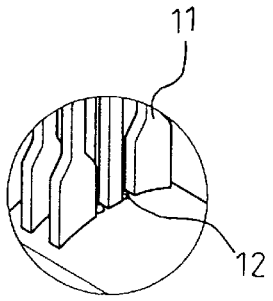
FIG. 3A is a partially enlarged view of a comb strip of a preferred embodiment in accordance with the present invention.
Figure 3B:
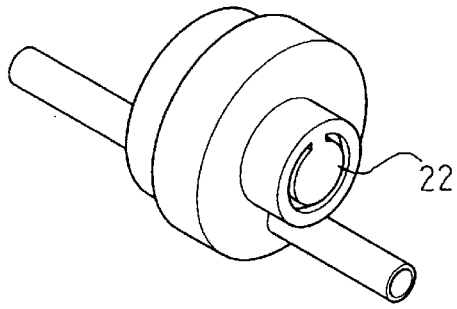
FIG. 3B is a perspective view of a connection disk of a preferred embodiment in accordance with the present invention.
Figure 3C:
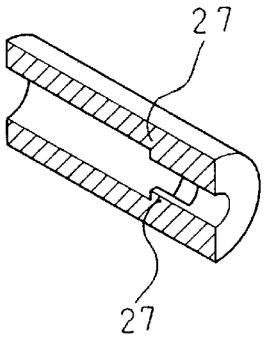
FIG. 3C is a sectional view of a pipe of a preferred embodiment in accordance with the present invention.

Referring to FIGS. 1 to 5, a hairdye comb 1 comprises a bottle-shaped handle 30, a ball 25, a hose 24, a connection disk 20, a comb strip 10, and a pipe 26 disposed in the bottle-shaped handle 30.

The bottle-shaped handle 30 has a neck 32 which has an outer thread 31.

A tube 23 passes through the connection disk 20.

A hollow seat 13 is connected to the comb strip 10.

A plurality of teeth 11 are disposed on the comb strip 10.

A plurality of slots 12 are formed on the comb strip 10.

The hollow seat 13 has an inner thread 14 and a round aperture 15.

The connection disk 20 has a valve diaphragm 22 and a through hole 21 communicating with the valve diaphragm 22.

The pipe 26 has an inner flange 27.

The ball 25 is inserted in the pipe 26 and blocked by the inner flange 27 of the pipe 26.

The hose 24 is connected to the pipe 26 and the tube 23.

The connection disk 20 is inserted in the neck 32 of the bottle-shaped handle 30.

The neck 32 of the bottle-shaped handle 30 is inserted in the hollow seat 13.

The inner thread 14 of the hollow seat 13 engages with the outer thread 31 of the neck 32 of the bottle-shaped handle 30.

The tube 23 communicates with the round aperture 15 of the hollow seat 13.

The bottle-shaped handle 30 contains a hairdye solution (not shown in the figures).

Figure 4:
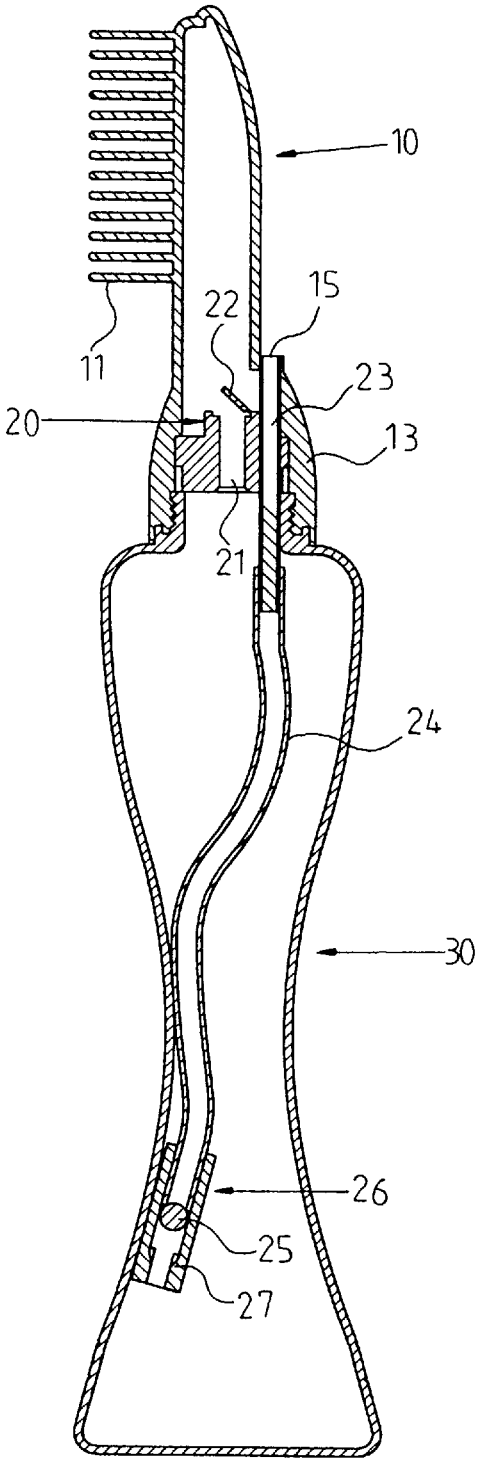
FIG. 4 is a sectional schematic view illustrating an operation of a hairdye comb of a preferred embodiment in accordance with the present invention.

Referring to FIGS. 4, the bottle-shaped handle 30 is squeezed. When the hairdye solution enters the pipe 26, the ball 25 blocks the hose 24. The hairdye solution flows into the through hole 21 of the connection disk 20 to push the valve diaphragm 22 outward and flows into the comb strip 10.

Figure 5:
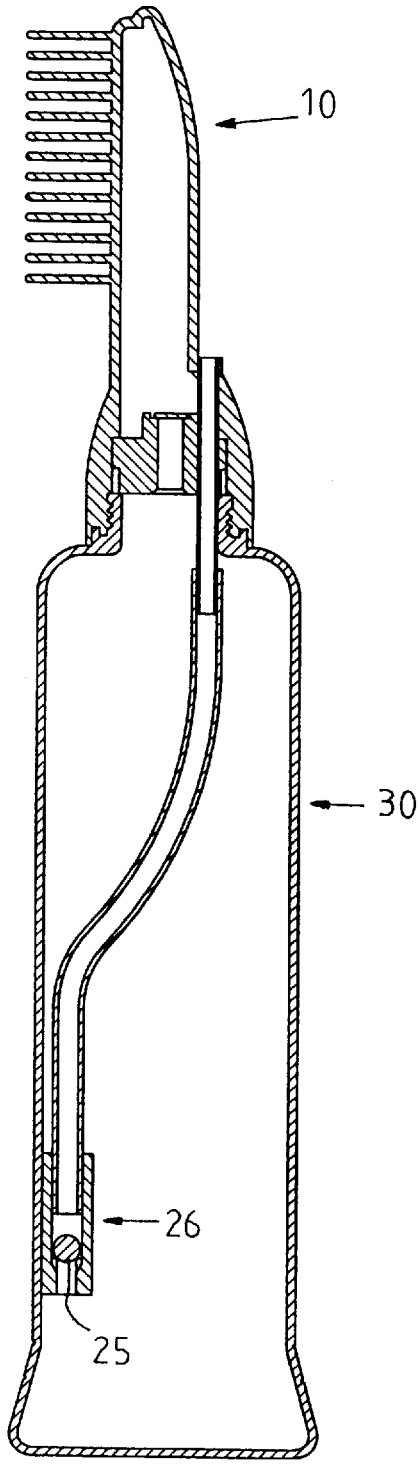
FIG. 5 is a sectional schematic view illustrating another operation of a hairdye comb of a preferred embodiment in accordance with the present invention.

Referring to FIG. 5, the bottle-shaped handle 30 is not squeezed. An air enters the round aperture 15 of the hollow seat 13, the tube 23, the hose 24, the pipe 26, and the bottle-shaped handle 30.

The invention is not limited to the above embodiment but various modification thereof may be made. Further, various changes in form and detail may be made without departing from the scope of the invention.

What is claimed is:

1. A hairdye comb comprises:

a bottle-shaped handle, a connection disk, a comb strip, a ball, a hose, and a pipe disposed in the bottle-shaped handle, the bottle-shaped handle having a neck having an outer thread, a tube passing through the connection disk, a hollow seat connected to the comb strip, a plurality of teeth disposed on the comb strip, a plurality of slots formed on the comb strip, the hollow seat having an inner thread and a round aperture, the connection disk having a valve diaphragm and a through hole communicating with the valve diaphragm, the pipe having an inner flange, the ball inserted in the pipe and blocked by the inner flange of the pipe, the hose connected to the pipe and the tube, the connection disk inserted in the neck of the bottle-shaped handle, the neck of the bottle-shaped handle inserted in the hollow seat, the inner thread of the hollow seat engaging with the outer thread of the neck of the bottle-shaped handle, and the tube communicating with the round aperture of the hollow seat.

* * * * *